US009983536B2

(12) United States Patent
Terao

(10) Patent No.: US 9,983,536 B2
(45) Date of Patent: May 29, 2018

(54) IMAGE FORMING SYSTEM THAT ADJUSTS A DISCHARGE INTERVAL FROM AN IMAGE FORMING SECTION ACCORDING TO A SPEED OF A MOTOR IN A POST PROCESSING SECTION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yasunobu Terao, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/256,868

(22) Filed: Sep. 6, 2016

(65) Prior Publication Data

US 2018/0067441 A1 Mar. 8, 2018

(51) Int. Cl.
*G03G 15/00* (2006.01)
*B65H 5/34* (2006.01)

(52) U.S. Cl.
CPC ..... *G03G 15/6582* (2013.01); *B65H 5/34* (2013.01); *G03G 15/55* (2013.01); *B65H 2601/121* (2013.01)

(58) Field of Classification Search
CPC ..... G03G 15/55; B65H 5/34; B65H 2601/121
See application file for complete search history.

(56) References Cited

U.S. PATENT DOCUMENTS

| | | | | |
|---|---|---|---|---|
| 6,507,768 | B1 * | 1/2003 | Regimbal | B41J 13/0009 700/213 |
| 7,559,543 | B2 * | 7/2009 | Moriyama | B42C 1/125 270/58.02 |
| 8,146,907 | B2 * | 4/2012 | Kato | B65H 7/10 270/58.07 |
| 2007/0009270 | A1 * | 1/2007 | Kawano | G03G 15/6529 399/13 |

FOREIGN PATENT DOCUMENTS

| | | |
|---|---|---|
| JP | 10-181989 | 7/1998 |
| JP | 2002-006692 | 1/2002 |

* cited by examiner

*Primary Examiner* — Justin Olamit
(74) *Attorney, Agent, or Firm* — Amin, Turocy & Watson LLP; Gregory Turocy

(57) ABSTRACT

In accordance with an embodiment, a sheet processing apparatus, containing a controller that acquires a predetermined data associated with a physical quantity of one of a driving motor or a driven member driven by the motor based on a predetermined signal, compare the predetermined data with a threshold value, and determine whether to transmit a request for increasing a discharge interval of a sheet based on the comparative result.

6 Claims, 6 Drawing Sheets

IMAGE FORMING SYSTEM THAT ADJUSTS A DISCHARGE INTERVAL FROM AN IMAGE FORMING SECTION ACCORDING TO A SPEED OF A MOTOR IN A POST PROCESSING SECTION

FIELD

Embodiments described herein relate generally to a post-processing apparatus, a control method and an image forming system.

BACKGROUND

There is an image forming system equipped with a post processing apparatus for carrying out a post-processing on a sheet and an image forming apparatus. The post-processing apparatus is equipped with various driven members. Parts of the driven members are driven by a DC (Direct Current) motor. A rotational speed of the DC motor is reduced if the DC motor approaches the end of its lifetime.

If the rotational speed of the DC motor is reduced, a drive speed of the driven member is reduced. If the drive speed of the driven member is reduced, there is a case in which a paper jam occurs or an alignment state of discharged sheets becomes faulty. In this way, if the rotational speed of the DC motor is reduced, there is a case in which a stable operation of the post-processing apparatus becomes difficult.

DETAILED DESCRIPTION

In accordance with an embodiment, a sheet processing apparatus, comprising a sheet processing section configured to carry out a post-processing on a sheet discharged from an image forming apparatus; a motor configured to drive a driven member of the sheet processing section; an encoder configured to output a predetermined signal based on a rotation of an axis to which rotational force of the motor is transmitted; a memory configured to store a threshold value; and a controller configured to acquire a predetermined data associated with a physical quantity of one of the driving motor or the driven member driven by the motor based on the predetermined signal, compare the predetermined data with the threshold value, and determine whether to transmit a request for increasing a discharge interval of the sheet discharged from the image forming apparatus to the image forming apparatus based on the comparative result.

Figure 1:
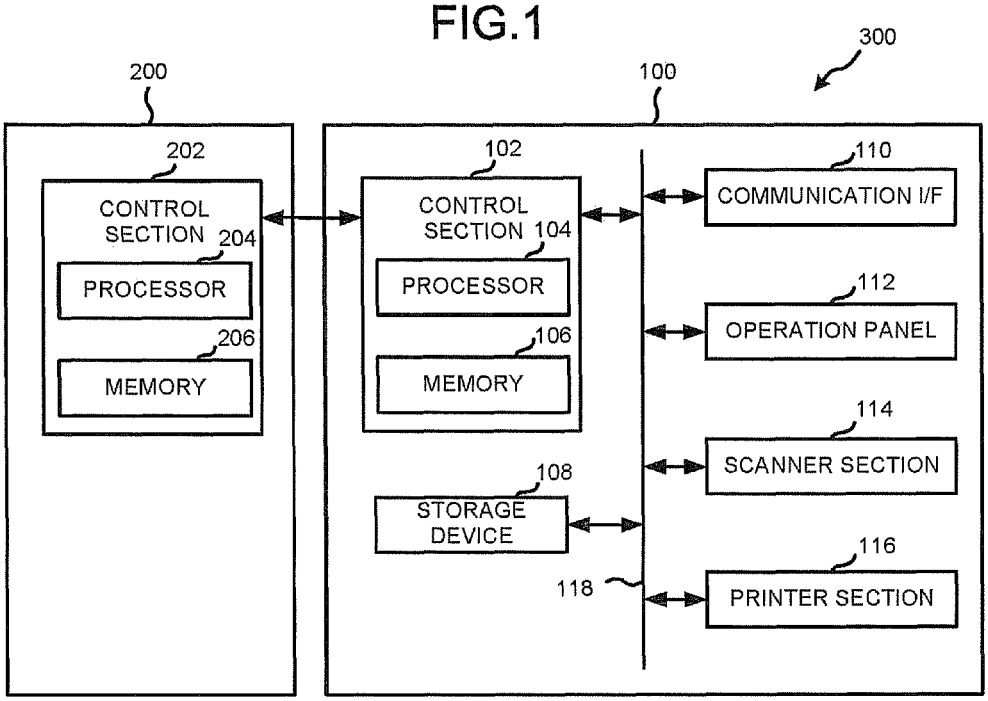
FIG. 1 is a diagram illustrating the schematic configuration of an image forming system according to an embodiment.

FIG. 1 is a diagram illustrating the schematic configuration of an image forming system 300. The image forming system 300 is composed of an image forming apparatus 100 and a post-processing apparatus 200. The image forming apparatus 100 has a control section 102 (controller), a storage device 108, a communication interface (communication I/F) 110 an operation panel 112, a scanner section 114 and a printer section (image forming section) 116 for forming an image. Components of the image forming apparatus 100 are connected with each other via a bus line 118.

The control section 102 has a processor 104 composed of a CPU (Central Processing Unit) or a MPU (Micro Processing Unit) and a memory 106. The memory 106 has a ROM (Read Only Memory) and a RAM (Random Access Memory).

A control program is stored in the ROM. The RAM provides a temporary working area for the processor 104.

The control section 102 controls each section on the basis of various programs stored in the ROM or the storage device 108. For example, the control section 102 controls the operation panel 112, the scanner section 114 and the printer section 116. The control section 102 includes a function of correcting image data or a function of expanding the image data. Further, the control section 102 communicates with a control section 202 of the post-processing apparatus 200.

The storage device 108 stores application programs and an OS (Operating System). The application programs include programs for realizing functions of a multi-function peripheral. As the functions of the multi-function peripheral, for example, a copy function, a print function, a scan function, a facsimile function and a network file function are listed. The application programs include an application for Web client (Web browser) and other applications.

The storage device 108 temporarily stores image data of a document read by the scanner section 114 or image data acquired via the communication I/F 110. The storage device 108 properly stores software update, a protected electronic document, text data, account information and policy information.

The storage device 108 is composed of at least one or more of a magnetic storage device, an optical storage device and a semiconductor storage device.

The communication I/F 110 is an interface for connecting with an external device. The communication I/F 110 connects with the external device through a wireless or a wired manner. As a wireless or a wired standard, for example, Bluetooth® Technology, IEEE802.15, IEEE802.11, IEEE802.3 and IEEE1284 are listed. The communication I/F 110 may be a USB connection section to which a connection terminal of a USB standard is connected or a parallel interface.

The control section 102 communicates with a user terminal, a USB device or another external device via the communication I/F 110.

The post-processing apparatus 200 has the control section 202 and a plurality of members described later. The control section 202 (controller) has a processor 204 composed of a CPU or a MPU and a memory 206.

The memory 206 has a ROM and a RAM. A control program is stored in the ROM. The RAM provides a temporary working area for the processor 204.

The control section 202 communicates with the control section 102 of the image forming apparatus 100. The control section 202 controls a plurality of the members described later on the basis of information received from the control section 102 or various programs stored in the ROM.

Figure 2:
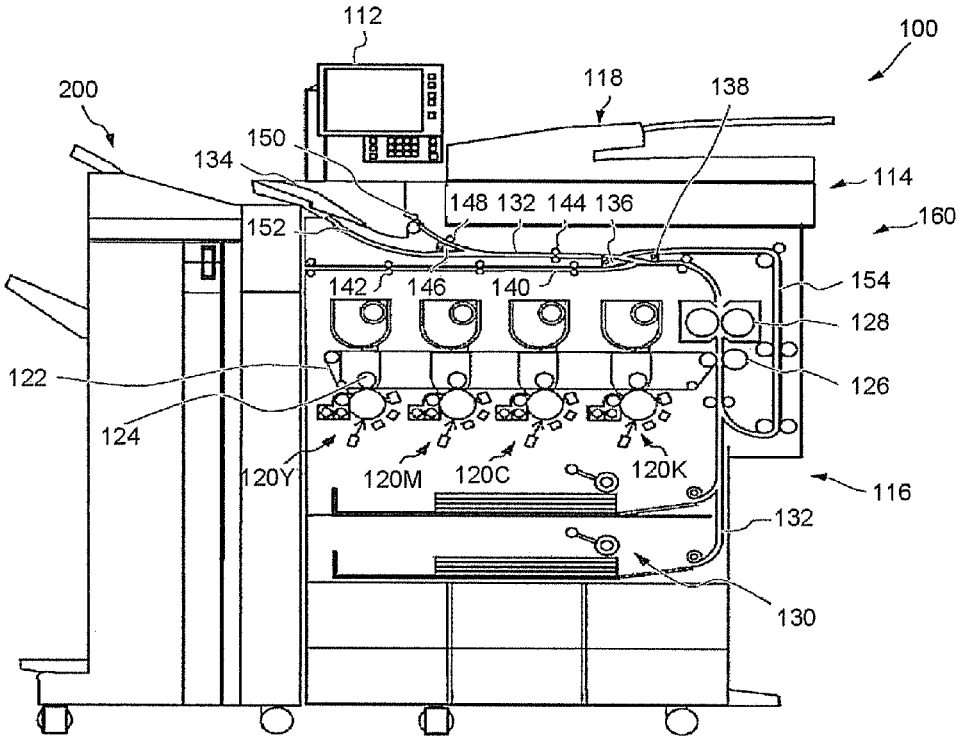
FIG. 2 is a diagram illustrating the schematic configuration of an image forming apparatus.

FIG. 2 is a diagram illustrating the schematic configuration of the image forming apparatus 100. The image forming apparatus 100 has the operation panel 112, the scanner section 114, the printer section 116, a sheet feed section 130, an upper stage sheet discharge tray 134 and a first conveyance path.

The operation panel 112 has a touch panel type display section and various operation keys. The operation keys include, for example, a numeric keypad, a reset key, a stop key and a start key.

The display section displays an instruction item relating to a printing condition. A print item displayed on the display section is, for example, an item relating to a printing condition such as a sheet size, the number of copies, print density setting or finishing (stapling). The instruction of the displayed item is input from the display section. The operation panel 112 is an interface for receiving an instruction from a user.

The scanner section 114 has a reading unit. The reading unit has a document placing table, a carriage, an exposure lamp, a reflecting mirror, an imaging lens and a CCD (Charge Coupled Device).

The CCD is a photoelectric conversion element for acquiring reflected light to convert the reflected light to an electrical signal. There is an automatic document feeder 118 for conveying a document to a reading position above the document placing table. The reading unit of the scanner section 114 reads a document set in the document placing table or the automatic document feeder 118.

The printer section 116 forms an image corresponding to image data on the sheet. As the image data, the image data of the document read by the scanner section 114 and the image data received from the user terminal are listed.

The printer section 116 has a process unit 120, an intermediate transfer belt 122, a primary transfer device 124, a secondary transfer device 126 and a fixing section 128.

The process unit 120 has four process units 120Y, 120M, 120C and 120K. The process unit 120 is arranged in parallel on the intermediate transfer belt 122.

The process unit 120Y corresponds to yellow (Y) toner (recording material). The process unit 120M corresponds to magenta (M) toner. The process unit 120C corresponds to cyan (C) toner. The process unit 120K corresponds to black (K) toner.

The process unit 120 has a photoconductor, a laser unit, a charging device, a developing device, a cleaner and a discharge lamp. The laser unit forms an electrostatic latent image on the photoconductor. The charging device is arranged around the photoconductor. If an image forming processing is started by the printer section 116, the process unit 120 forms a toner image on the photoconductor.

The primary transfer device 124 faces the photoconductor of the process unit 120 across the intermediate transfer belt 122 as a transfer body. The primary transfer device 124 electrostatically transfers the toner image on the photoconductor onto the intermediate transfer belt 122.

The secondary transfer device 126 electrostatically transfers the toner image which is transferred onto the intermediate transfer belt 122 onto the sheet conveyed from the sheet feed section 130. The fixing section 128 fixes the toner image on the sheet.

The first conveyance path 132 conveys the sheet fed from the sheet feed section 130 to the fixing section 128 or the upper stage sheet discharge tray 134. There is a first branch member 136 and a second branch member 138 at the downstream side of the fixing section 128. The first branch member 136 and the second branch member 138 switch a conveyance direction of the conveyed sheet. The first branch member 136 conveys the sheet conveyed in the first conveyance path 132 to the direction of a second conveyance path 140 or the upper stage sheet discharge tray 134. The second branch member 138 is arranged at the upstream side of the sheet conveyance direction with respect to the first branch member 136 in the first conveyance path 132.

The second conveyance path 140 branches off from the first conveyance path 132 at a branch point at which the first branch member 136 is arranged. The second conveyance path 140 has a conveyance roller 142. The second conveyance path 140 conveys the sheet to the post-processing apparatus 200.

A reversal roller 144, a third branch member 146, and a reversal paper path 152 are arranged at the downstream side of the sheet conveyance direction with respect to the first branch member 136. A conveyance roller 148 and a sheet discharge roller 150 are further arranged at the downstream side of the sheet conveyance direction with respect to the first branch member 136.

If the sheet is guided to the reversal roller 144 by the first branch member 136, the sheet is conveyed to the sheet discharge roller 150. At this time, the sheet is conveyed to the sheet discharge roller 150 through the reversal roller 144, the third branch member 146 and the conveyance roller 148. The sheet discharge roller 150 discharges the sheet to the upper stage sheet discharge tray 134.

Figure 3:
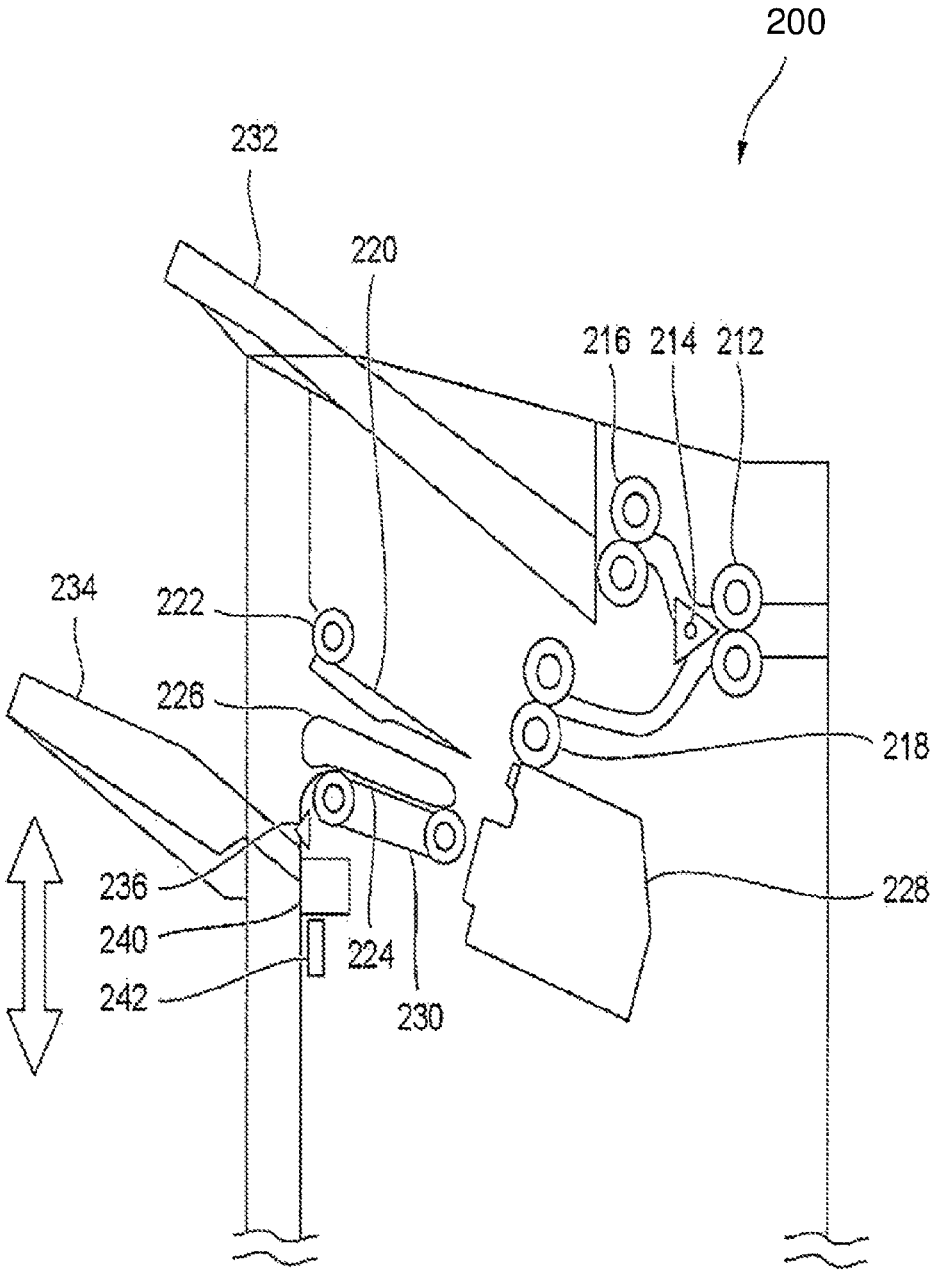
FIG. 3 is a diagram illustrating the schematic configuration of a post-processing apparatus.

FIG. 3 is a diagram illustrating the schematic configuration of the post-processing apparatus 200. The post-processing apparatus 200 processes the sheet discharged from the image forming apparatus 100 according to an input instruction from the operation panel 112 or an instruction from user equipment. The post-processing apparatus 200 has an inlet roller 212, a branch member 214, a sheet discharge roller 216, an exit roller 218, a standby tray 220, a standby roller 222, a processing tray 224, an alignment member 226, a stapler 228, a sheet bundle discharge member 230, a fixed tray 232, a movable tray 234, a DC motor 240 and an encoder 242.

The inlet roller 212 receives the sheet discharged from the image forming apparatus 100 and conveys the received sheet to the branch member 214. The branch member 214 guides the sheet to the sheet discharge roller 216 or the exit roller 218.

If the branch member 214 guides the sheet to the sheet discharge roller 216, the sheet discharge roller 216 discharges the sheet to the fixed tray 232. On the other hand, if the branch member 214 guides the sheet to the exit roller 218, the exit roller 218 conveys the sheet to the standby tray 220.

The standby tray 220 temporarily holds a plurality of the conveyed sheets. If supporting the predetermined number of the sheets, the standby tray 220 drops the supported sheets to the processing tray 224.

The processing tray 224 catches the sheets dropped from the standby tray 220. The processing tray 224 supports the loaded sheets while the sheets are stapled. The alignment member 226 aligns a width direction intersecting with a conveyance direction of a sheet bundle on the processing tray 224. The stapler 228 staples the end part of the aligned sheet bundle.

The sheet bundle discharge member 230 discharges the stapled sheet bundle to the movable tray 234. Furthermore, the sheet bundle discharge member 230 may discharge the sheet bundle to the movable tray 234 after the alignment member 226 aligns the sheet bundle without stapling the sheet bundle.

The standby tray 220 can also directly convey the supported sheet to the direction of the movable tray 234 and discharge the supported sheet without dropping the supported sheet to the processing tray 224. In this case, the standby tray 220 and the standby roller 222 discharge the sheets one by one to the movable tray 234 without stopping the sheets on the standby tray 220.

The movable tray 234 is a driven member which is driven by the DC motor 240 in the vertical direction. The encoder 242 converts a revolution speed of an axis to which rotational force of the DC motor 240 is transmitted to a pulse and outputs the pulse to the control section 202. Specifically, the encoder 242 converts the revolution speed of the rotation axis obtained when a rotational speed of the DC motor 240 is decelerated to the pulse.

A detection member 236 detects the upper surface of the movable tray 234 or the top surface of the sheets loaded on the movable tray 234. The detection member 236 detects a position of the movable tray 234.

The movable tray 234 ascends or descends according to the discharge of the sheet from the standby tray 220, the discharge of the sheet from the processing tray 224 and a loading amount of the sheets. The movable tray 234 catches the discharged sheet at a position at which the detection member 236 detects the upper surface or the top surface. The movable tray 234 moves downwards, for example, when one or a plurality of sheets are discharged.

If the detection member 236 does not detect the top surface of the sheets loaded on the movable tray 234, the movable tray 234 moves upwards. The movable tray 234 moves to a position at which the detection member 236 detects the top surface of the sheets loaded on the movable tray 234 to load the discharged sheet.

In such a movable tray 234, if the lifetime of the DC motor 240 approaches and the rotational speed is reduced, paper jam occurs or an alignment state of the discharged sheets becomes faulty. In other words, the discharged sheets are in a disturbed state.

Specifically, in a state in which the sheets are loaded, if the descent of the movable tray 234 becomes slow, a sheet discharge port of the processing tray 224 becomes a blocked state. In this state, if the sheets are discharged by the processing tray 224, the paper jam occurs.

On the contrary, if the ascent of the movable tray 234 becomes slow, a distance between the sheet discharge port of the processing tray 224 and the movable tray 234 becomes an unnecessarily long state. In this state, if the sheets are discharged by the processing tray 224, the discharged sheets drop dancing in the air, and thus the alignment state of the discharged sheets becomes faulty.

Thus, the post-processing apparatus 200 makes a request to the image forming apparatus for a reduction in a processing speed if it is determined that the performance of the DC motor 240 becomes worse or the lifetime of the DC motor 240 approaches.

Figure 4:
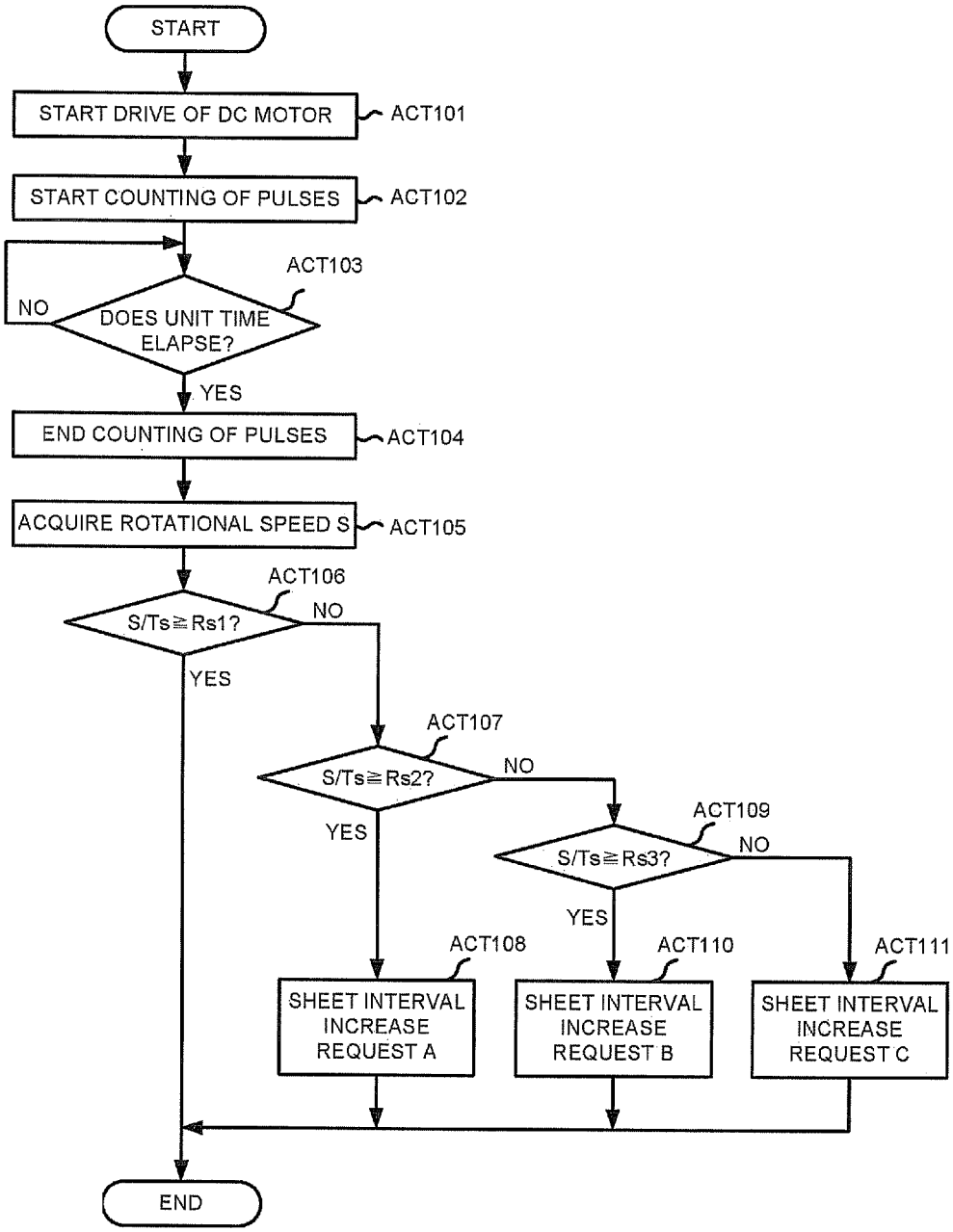
FIG. 4 is a diagram illustrating an example of operations of the post-processing apparatus.

FIG. 4 is a diagram illustrating an example of operations of the post-processing apparatus 200 according to the embodiment.

S, Ts, Rs1, Rs2 and Rs3 shown in FIG. 4 are described. The S is the rotational speed of the DC motor 240. The Ts is a standard value which is compared with the rotational speed S. The Ts is the rotational speed of the DC motor 240 determined in a factory before shipment of the post-processing apparatus 200. The Ts is stored in the memory 206. A comparative result between the standard value Ts and the rotational speed S is a ratio (S/Ts) of the S to the standard value Ts.

The Rs1, the Rs2 and the Rs3 (1>Rs1>Rs2>Rs3) are threshold value to be used for a comparison with the ratio (S/Ts) of the S to the standard value Ts. The ratio of the S to the standard value Ts is reduced with the approach of the lifetime of the DC motor 240. The threshold value Rs1, Rs2 and Rs3 may be stored in the memory 206.

If the ratio is equal to or greater than the Rs1, the control section 202 determines that the lifetime (performance) of the DC motor is sufficient and does not make a request for the reduction in the processing speed. On the other hand, if the ratio is smaller than the Rs1, the control section 202 makes a request for the reduction in the processing speed to the image forming apparatus 100.

A sheet interval increase request shown in FIG. 4 is a request for increasing a sheet discharge interval of each sheet, compared with normal time. Thus, the sheet interval increase request is a request for reducing the processing speed. The intervals requested by different sheet interval increase requests become longer in the order of a sheet interval increase request A, a sheet interval increase request B and a sheet interval increase request C.

The example of the operations shown in FIG. 4 is carried out in a state in which the sheets are not loaded on the movable tray 234. This is because a correct rotational speed cannot be detected if the sheets are loaded on the movable tray 234. Thus, the example of the operations shown in FIG. 4 is carried out, for example, according to an instruction of a service technician.

The control section 202 starts drive of the DC motor 240 in order to drive the movable tray 234 (ACT 101). The control section 202 starts counting of the pulses output by the encoder 242 (ACT 102).

If a predetermined time, for example, unit time elapses (YES in ACT 103), the control section 202 ends the counting of the pulses (ACT 104). The control section 202 acquires the rotational speed S from the counted number of the pulses (ACT 105).

The control section 202 determines whether or not (S/Ts) is equal to or greater than the Rs1 (ACT 106). If it is determined that (S/Ts) is equal to or greater than the Rs1 (YES in ACT 106), the control section 202 ends the present processing.

If it is determined that (S/Ts) is not equal to or greater than the Rs1 (NO in ACT 106), the control section 202 proceeds to a processing in ACT 107. The control section 202 determines whether or not (S/Ts) is equal to or greater than the Rs2 (ACT 107).

If it is determined that (S/Ts) is equal to or greater than the Rs2 (YES in ACT 107), the control section 202 makes a request to the image forming apparatus 100 for the sheet interval increase request A (ACT 108), and ends the present processing.

In the processing in ACT 107, if it is determined that (S/Ts) is not equal to or greater than the Rs2 (NO in ACT 107), the control section 202 proceeds to a processing in ACT 109. The control section 202 determines whether or not (S/Ts) is equal to or greater than the Rs3 (ACT 109).

If it is determined that (S/Ts) is equal to or greater than the Rs3 (YES in ACT 109), the control section 202 proceeds to a processing in ACT 110. The control section 202 makes a request to the image forming apparatus 100 for the sheet interval increase request B (ACT 110), and ends the present processing.

In the foregoing processing in ACT 109, if it is determined that (S/Ts) is not equal to or greater than the Rs3 (NO in ACT 109), the control section 202 proceeds to a processing in ACT 111. The control section 202 makes a request to the image forming apparatus 100 for the sheet interval increase request C (ACT 111), and ends the present processing.

As shown in the example of the operations described above, the sheet discharge interval in the sheet interval increase request is increased according to the reduction in the ratio of the rotational speed S to the threshold value Ts.

The length of the interval requested by each sheet interval increase request may be optional as long as the post-processing apparatus 200 can stably operate in the interval, compared with a case in which the sheet interval increase request is not carried out.

In FIG. 4 described above, the lifetime (performance degradation) of the DC motor is determined according to three threshold values, that is, Rs1, Rs2 and Rs3; however, the present invention is not limited to this. The lifetime of the DC motor may be determined according to one threshold value, two threshold values or four or more threshold values. The value of each Rs is suitably determined according to characteristics of the DC motor or the configuration of the mechanism. As an example of the Rs1, 0.9 is exemplified. As an example of the Rs2, 0.8 is exemplified. As an example of the Rs3, 0.7 is exemplified.

In FIG. 4 described above, the Ts is the rotational speed of the DC motor 240 which is detected in the factory; however, the Ts may be a fixed value.

The DC motor is not limited to driving the movable tray and also drives other driven members. In a punch processing, the DC motor drives a member which punches a punch hole on the sheet. In the stapling processing, the DC motor drives a member which staples the sheets. In the folding processing, the DC motor drives a roller which discharges the sheet.

Figure 5:
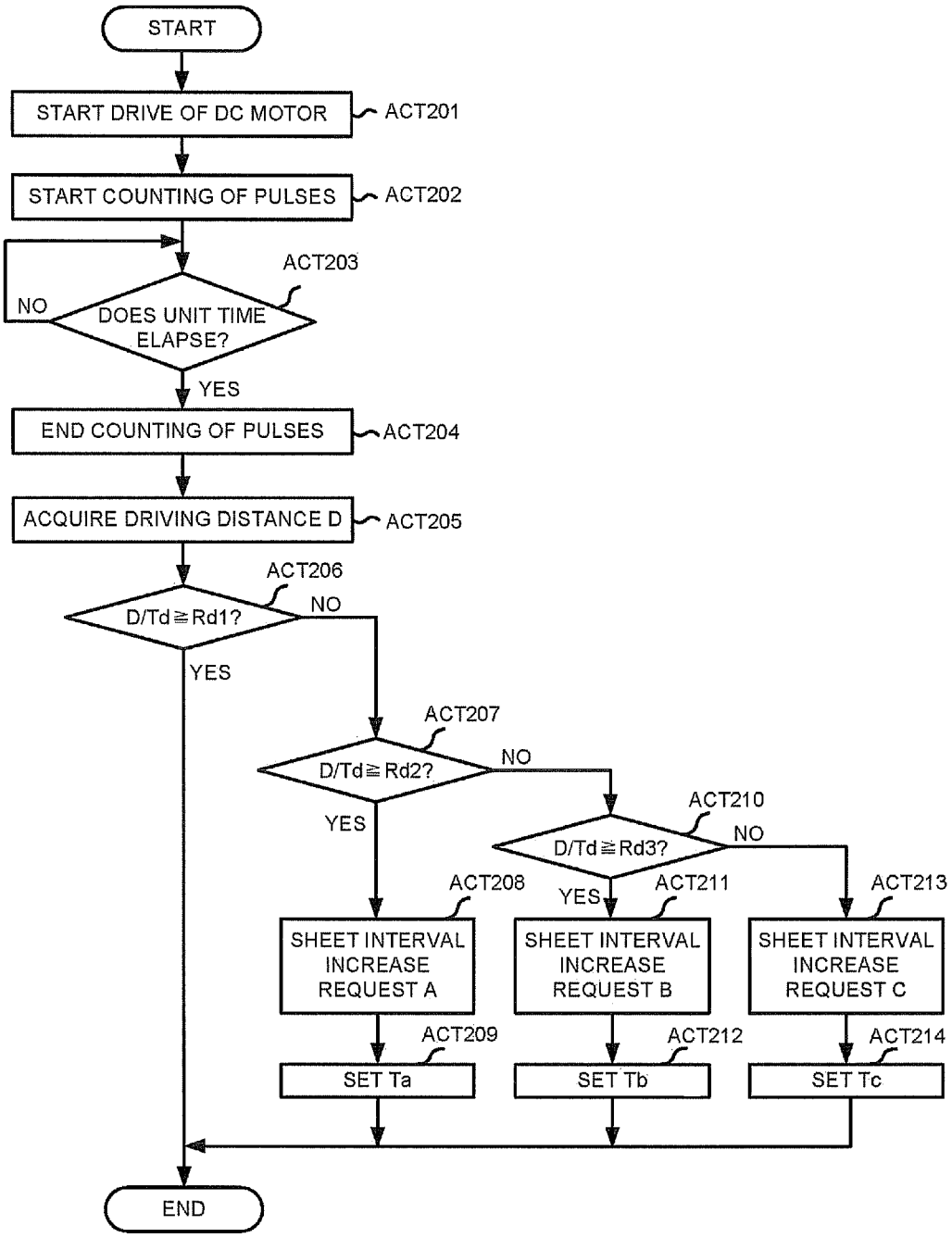
FIG. 5 is a diagram illustrating an example of operations of the post-processing apparatus.

FIG. 5 is a diagram illustrating an example of operations of the post-processing apparatus 200 in the punch processing according to the embodiment. A punch processing mechanism for carrying out the punch processing is not shown in FIG. 3; however, a punch is driven by the DC motor. Further, the punch processing mechanism has an encoder for converting a revolution speed of an axis to which the rotational force of the DC motor is transmitted to a pulse.

D, Td, Rd1, Rd2 and Rd3 shown in FIG. 5 are described. The D is a driving distance of a punch blade of the punch. The Td is a standard value compared with the driving distance D. The Td is a driving distance which is determined in the factory before the shipment of the post-processing apparatus 200. The Td is stored in the memory 206. A comparative result between the standard value Td and the driving distance D is a ratio (D/Td) of the D to the standard value Td.

The Rd1, the Rd2 and the Rd3 (1>Rd1>Rd2>Rd3) are threshold values to be used for a comparison with the ratio (D/Td) of the driving distance D to the standard value Td. The ratio of the driving distance D to the standard value Td is reduced with the approach of the lifetime of the DC motor. The threshold values Rd1, Rd2 and Rd3 may be stored in the memory 206.

If the ratio is equal to or greater than the Rd1, the control section 202 determines that the lifetime (performance) of the DC motor is sufficient and does not make a request for the reduction in the processing speed. On the other hand, if the ratio is smaller than the Rd1, the control section 202 makes a request for the reduction in the processing speed to the image forming apparatus 100.

A sheet interval increase request shown in FIG. 5 is identical to the sheet interval increase request shown in FIG. 4. Furthermore, in FIG. 5, the reason why the sheet discharge interval is increased is that the punch hole is punched on each one sheet.

In the example of the operations shown in FIG. 5, the DC motor 240 drives the punch without the sheet. This is because a correct driving distance cannot be detected if the sheet is punched actually. Thus, the example of the operations shown in FIG. 5 is carried out, for example, according to an instruction of the service technician.

The control section 202 starts drive of the DC motor 240 in order to drive the punch (ACT 201). The control section 202 starts counting of the pulses output by the encoder (ACT 202).

If a predetermined time, for example, unit time elapses (YES in ACT 203), the control section 202 ends the counting of the pulses (ACT 204). The control section 202 acquires the driving distance D of the punch from the counted number of the pulses (ACT 205).

The control section 202 determines whether or not the (D/Td) is equal to or greater than the Rd1 (ACT 206). If it is determined that the (D/Td) is equal to or greater than the Rd1 (YES in ACT 206), the control section 202 ends the present processing.

If it is determined that the (D/Td) is not equal to or greater than the Rd1 (NO in ACT 206), the control section 202 proceeds to a processing in ACT 207. The control section 202 determines whether or not the (D/Td) is equal to or greater than the Rd2 (ACT 207).

If it is determined that the (D/Td) is equal to or greater than the Rd2 (YES in ACT 207), the control section 202 makes a request to the image forming apparatus 100 for the sheet interval increase request A (ACT 208).

The control section 202 sets conveyance stop time Ta (ACT 209), and ends the present processing. The conveyance stop time refers to time at which the conveyance of the sheet is stopped at the time the punch hole is punched. If the rotational force of the DC motor is reduced, the time for punching the hole is increased. Thus, the control section 202 increases conveyance stop time to the conveyance stop time Ta longer than normal conveyance stop time.

In the foregoing processing in ACT 206, if it is determined that the (D/Td) is not equal to or greater than the Rd2 (NO in ACT 207), the control section 202 proceeds to a processing in ACT 210. The control section 202 determines whether or not the (D/Td) is equal to or greater than the Rd3 (ACT 210).

If it is determined that the (D/Td) is equal to or greater than the Rd3 (YES in ACT 210), the control section 202 proceeds to a processing in ACT 211. The control section 202 makes a request to the image forming apparatus 100 for the sheet interval increase request B (ACT 211).

The control section 202 sets conveyance stop time Tb (ACT 212), and ends the present processing. The foregoing conveyance stop time Tb is longer than the conveyance stop time Ta.

In the foregoing processing in ACT 210, if it is determined that the (D/Td) is not equal to or greater than the Rd3 (NO in ACT 210), the control section 202 proceeds to a processing in ACT 213. The control section 202 makes a request to the image forming apparatus 100 for the sheet interval increase request C (ACT 213).

As shown in the example of the operations described above, the sheet discharge interval in the sheet interval increase request is increased according to the reduction in the ratio of the driving distance D to the threshold value Td.

The length of the interval requested by each sheet interval increase request may be optional as long as the post-processing apparatus 200 can stably operate in the interval, compared with a case in which the sheet interval increase request is not carried out.

The control section 202 sets conveyance stop time Tc (ACT 214), and ends the present processing. The foregoing conveyance stop time Tc is longer than the conveyance stop time Tb.

Thus, the conveyance stop time becomes longer in the order of the conveyance stop time Ta, the conveyance stop time Tb and the conveyance stop time Tc.

In FIG. 5 described above, the lifetime (performance degradation) of the DC motor is determined according to three threshold values, that is, Rd1, Rd2 and Rd3; however, the present invention is not limited to this. The lifetime of the DC motor may be determined according to one threshold value, two threshold values or four or more threshold values. The value of each Rd is suitably determined according to the characteristics of the DC motor or the configuration of the mechanism. As an example of the Rd1, 0.9 is exemplified. As an example of the Rd2, 0.8 is exemplified. As an example of the Rd3, 0.7 is exemplified.

In FIG. 5 described above, the Td is the driving distance of the punch which is detected in the factory; however, the Td may be a fixed value.

Figure 6:
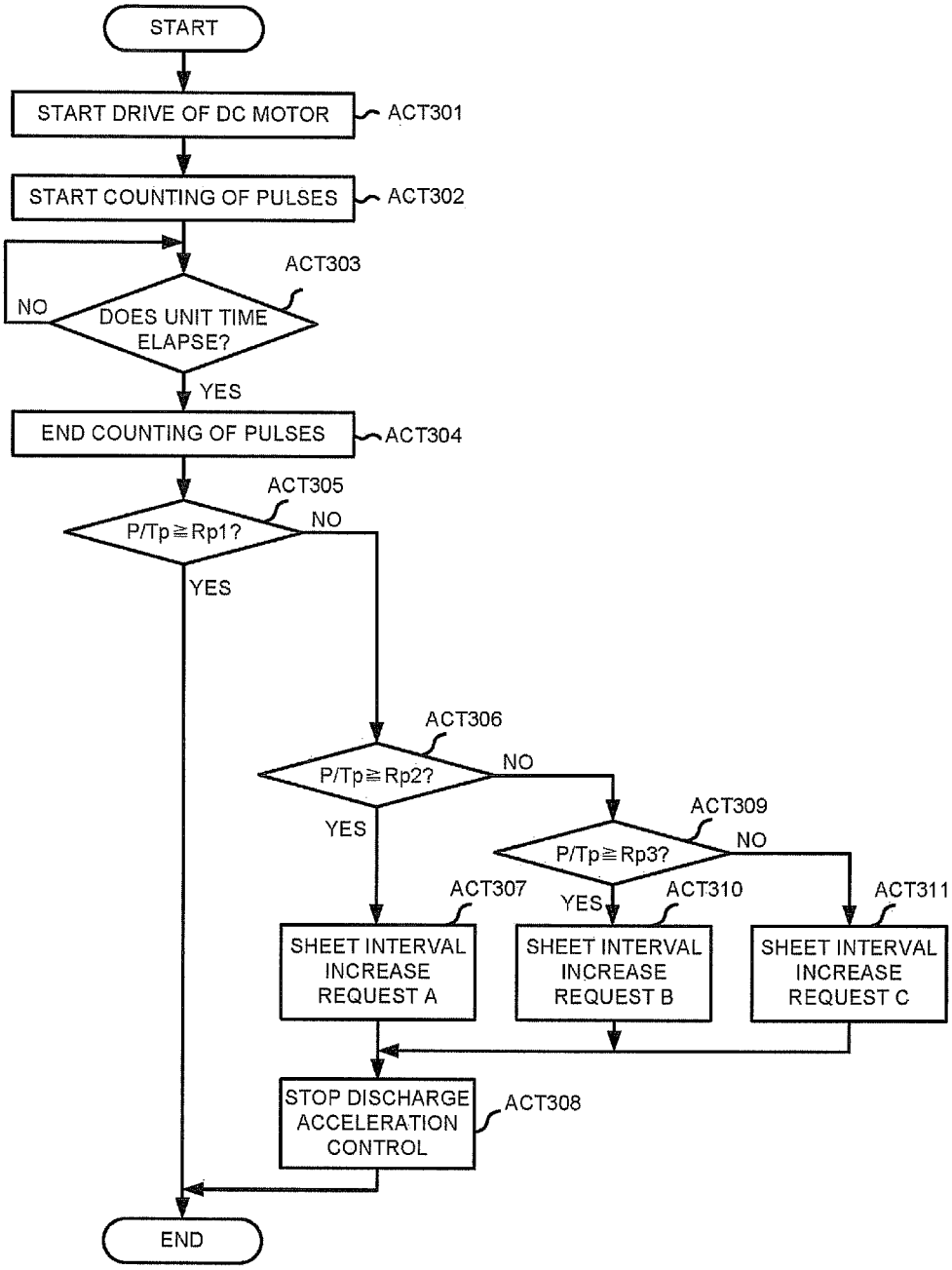
FIG. 6 is a diagram illustrating an example of operations of the post-processing apparatus.

FIG. 6 is a diagram illustrating an example of operations of the post-processing apparatus 200 in the folding processing according to the embodiment. A folding processing mechanism for carrying out the folding processing includes a pair of folding rollers and a folding blade, but is not shown in FIG. 3. In the folding processing, the front end of the folding blade pushes a sheet bundle at a position where a fold line is made to a nip portion of the pair of the folding rollers. The folding rollers driven by the DC motor folds the sheet. Then the pushed sheet is accelerated by the folding rollers driven by the DC motor to be discharged. The counted number of the pulses at the time when predetermined time elapses after the DC motor drives corresponds to a physical quantity which is detected through the drive of the DC motor.

P, Tp, Rp1, Rp2 and Rp3 shown in FIG. 6 are described. The P is the counted number of the pulses. The Tp is a standard value compared with the counted number P. The Tp is the counted number of the pulses which is determined in the factory before the shipment of the post-processing apparatus 200. The Tp is stored in the memory 206. A comparative result between the standard value Tp and the counted number P is a ratio (P/Tp) of the P to the standard value Tp.

The Rp1, the Rp2 and the Rp3 (1>Rp1>Rp2>Rp3) are threshold values to be used for a comparison with the ratio (P/Tp) of the P to the threshold value Tp. The ratio of the P to the standard value Tp is reduced with the approach of the end of the lifetime of the DC motor 240. The threshold values Rp1, Rp2 and Rp3 may be stored in the memory 206.

If the ratio is equal to or greater than the Rp1, the control section 202 determines that the lifetime (performance) of the DC motor is sufficient and does not make a request for the reduction in the processing speed. On the other hand, if the ratio is smaller than the Rp1, the control section 202 makes a request for the reduction in the processing speed to the image forming apparatus 100.

A copy interval increase shown in FIG. 6 is a request for increasing a sheet discharge interval between copies, compared with normal time. The copy interval refers to an interval from a moment the last page of one copy is discharged to a moment the first page of the next copy is discharged. For example, in a case in which one copy has 10 pages, the sheet discharge interval from the tenth page of the one copy to the first page of the next copy is the copy interval. Thus, the copy interval increase request is a request for reducing the processing speed. The intervals requested by different copy interval increase requests become longer in the order of a copy interval increase request A, a copy interval increase request B and a copy interval increase request C. In FIG. 6, the reason why the copy interval is increased is that each copy is discharged in the folding processing.

In the example of the operations shown in FIG. 6, the folding rollers are driven without folding the sheet. This is because the corrected number of the pulses cannot be detected if the sheet is discharged actually. Thus, the example of the operations shown in FIG. 6 is carried out, for example, according to an instruction of the service technician.

The control section 202 starts drive of the DC motor 240 in order to drive the folding roller (ACT 301). The control section 202 counts the number of the pulses output by the encoder (ACT 302).

If a predetermined time, for example, unit time elapses (YES in ACT 303), the control section 202 ends the counting of the pulses (ACT 304). In this way, the control section 202 can acquire the counted number.

The control section 202 determines whether or not the (P/Tp) is equal to or greater than the Rp1 (ACT 305). If it is determined that the (P/Tp) is equal to or greater than the Rp1 (YES in ACT 305), the control section 202 ends the present processing.

If it is determined that the (P/Tp) is not equal to or greater than the Rp1 (NO in ACT 305), the control section 202 proceeds to a processing in ACT 306. The control section 202 determines whether or not the (P/Tp) is equal to or greater than the Rp2 (ACT 306).

If it is determined that the (P/Tp) is equal to or greater than the Rp2 (YES in ACT 306), the control section 202 makes a request to the image forming apparatus 100 for the copy interval increase request A (ACT 307).

The control section 202 stops discharge acceleration control (ACT 308), and ends the present processing. The discharge acceleration control accelerates the speed at which the sheet is discharged. Through the copy interval increase request, time can be enough, and thus the control section 202 discharges the sheet at a constant speed without carrying out the discharge acceleration control.

In the foregoing processing in ACT 306, if it is determined that the (P/Tp) is not equal to or greater than the Rp2 (NO in ACT 306), the control section 202 proceeds to a processing in ACT 309. The control section 202 determines whether or not the (P/Tp) is equal to or greater than the Rp3 (ACT 309).

If it is determined that the (P/Tp) is equal to or greater than the Rp3 (YES in ACT 309), the control section 202 proceeds to a processing in ACT 310. The control section 202 makes a request to the image forming apparatus 100 for the copy interval increase request B (ACT 310), and proceeds to the processing in ACT 308.

In the foregoing processing in ACT 309, if it is determined that the (P/Tp) is not equal to or greater than the Rp3 (NO in ACT 309), the control section 202 proceeds to a processing in ACT 311. The control section 202 makes a request to the image forming apparatus 100 for the copy interval increase request C (ACT 311), and proceeds to the processing in ACT 308. In this way, the sheet discharge interval in the request is increased according to the reduction in the ratio of the counted number P to the threshold value Tp.

The length of the interval requested by each copy interval increase request may be optional as long as the post-processing apparatus 200 can stably operate in the interval, compared with a case in which the copy interval increase request is not carried out.

In FIG. 6 described above, the lifetime of the DC motor is determined according to three threshold values, that is, Rp1, Rp2 and Rp3; however, the present invention is not limited to this. The lifetime of the DC motor may be determined according to one threshold value, two threshold values or four or more threshold values. The value of each Rd is suitably determined according to the characteristics of the DC motor or the configuration of the mechanism. As an example of the Rp1, 0.9 is exemplified. As an example of the Rp2, 0.8 is exemplified. As an example of the Rp3, 0.7 is exemplified.

In FIG. 6 described above, the Td is the counted number of the pulses which is detected in the factory; however, the Td may be a fixed value.

Furthermore, in FIG. 6, the control section 202 acquires the count number of the pulse per predetermined time of the DC motor but the control section 202 may measure processing time (period) while a DC motor of the folding roller drives for folding one sheet bundle. In this case, the control section 202 may compare the obtained processing time with a time as threshold value in the memory 206.

In the embodiment described above, in a case in which a plurality of the DC motors is arranged in the post-processing apparatus 200, a request for reducing a processing speed corresponding to a DC motor of which the lifetime is the nearest is carried out as a general rule. Exceptionally, a request for reducing a processing speed corresponding to a DC motor other than the DC motor of which the lifetime is the nearest may be carried out according to a processing content of the post-processing. Furthermore, the encoder 242 includes an incremental encoder, but is not limited to this. The encoder 242 may include an absolute encoder.

As the driven members driven by the DC motor, the movable tray, the punch and the roller for carrying out the folding processing are exemplified; however, the present invention is not limited to this. For example, the driven member may be a stapler or a roller for conveyance.

An execution timing of each of the examples of the operations described above may be, for example, a timing at which an initial operation at the time of power on is being carried out or a timing at which the paper jam is released.

According to the present embodiment described above, the post-processing apparatus can stably operate by making a request to the image forming apparatus for the reduction in the processing speed. Further, as the post-processing apparatus can stably operate, it is possible to extend an actual use period, compared with a case in which the present embodiment is not applied.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet processing apparatus, comprising:

a sheet processing section configured to carry out a post-processing on a sheet discharged from an image forming apparatus;

a motor configured to drive a driven member of the sheet processing section;

an encoder configured to convert a rotation of an axis of the motor to which rotational force of the motor is transmitted to a pulse;

memory configured to store a threshold value; and a controller configured to acquire a rotational speed of the motor based on a counted number obtained by counting pulses converted by the encoder, compare the rotational speed with the threshold value, and transmit a request for increasing a discharge interval of the sheet discharged from the image forming apparatus to the image forming apparatus if the rotational speed is smaller than the threshold value.

2. The sheet processing apparatus according to claim 1, wherein the driven member of the sheet processing section is a movable tray which moves in the vertical direction by the motor.

3. A sheet processing apparatus, comprising:

a sheet processing section configured to carry out a post-processing on a sheet discharged from an image forming apparatus;

a motor configured to drive a driven member of the sheet processing section;

an encoder configured to convert a rotation of an axis of the motor to which rotational force of the motor is transmitted to a pulse;

a memory configured to store a first rotational speed and a threshold value; and a controller configured to acquire a second rotational speed of the motor based on a counted number obtained by counting pulses converted by the encoder, acquire a ratio of the first rotational speed and the second rotational speed, and transmitting a request for increasing a discharge interval of the sheet discharged from the image forming apparatus to the image forming apparatus if the ratio is smaller than the threshold value.

4. A control method of a sheet processing apparatus which comprises a sheet processing section configured to carry out a sheet processing on a sheet discharged from an image forming apparatus, a motor configured to drive a driven member of the sheet processing section and a memory configured to store a threshold value, comprising receiving a pulse converted, by an encoder, from a rotation of an axis to which rotational force of the motor is transmitted;

acquiring a rotational speed of the motor based on a counted number obtained by counting pulses converted by the encoder, comparing the rotational speed with the threshold value; and transmitting a request for increasing a discharge interval of the sheet discharged from the image forming apparatus to the image forming apparatus if the rotational speed is smaller than the threshold value.

5. The method according to claim 4, wherein the sheet processing section is a movable tray which moves in the vertical direction by the motor.

6. A control method of a sheet processing apparatus which comprises a sheet processing section configured to carry out a sheet processing on a sheet discharged from an image forming apparatus, a motor configured to drive a driven member of the sheet processing section and a memory configured to store first rotational speed and a threshold value, comprising:

receiving a pulse converted, by an encoder, from a rotation of an axis to which rotational force of the motor is transmitted;

acquiring a second rotational speed of the motor based on a counted number obtained by counting the pulses, acquiring a ratio of the first rotational speed and the second rotational speed, transmitting a request for increasing a discharge interval of the sheet discharged from the image forming apparatus to the image forming apparatus if the ratio is smaller than the threshold value.

* * * * *